United States Patent [19]

Drzewiecki

[11] Patent Number: 4,523,611

[45] Date of Patent: Jun. 18, 1985

[54] FLUIDIC ABSOLUTE-TO-DIFFERENTIAL PRESSURE CONVERTER

[75] Inventor: Tadeusz Drzewiecki, Silver Spring, Md.

[73] Assignee: The United States of America as represented by the Secretary of the Army, Washington, D.C.

[21] Appl. No.: 492,120

[22] Filed: May 6, 1983

[51] Int. Cl.[3] ..... F15C 1/06; F15C 4/00

[52] U.S. Cl. ..... 137/804; 137/833; 137/836; 137/840; 137/835

[58] Field of Search ..... 137/803, 804, 825, 826, 137/820, 833, 834, 836, 840

[56] References Cited

U.S. PATENT DOCUMENTS

| | | | |
|---|---|---|---|
| 3,191,623 | 6/1965 | Bowles | 137/833 |
| 3,415,262 | 12/1968 | Chatmon | 137/834 |
| 3,420,255 | 1/1969 | Wilkerson | 137/840 |
| 3,529,612 | 9/1970 | Rausch | 137/836 |
| 3,566,689 | 3/1971 | Ringwall et al. | 137/804 |
| 3,570,514 | 3/1971 | Sutton et al. | 137/819 |
| 3,578,010 | 5/1971 | Campagnuolo | 137/840 |
| 3,703,633 | 11/1972 | Honada et al. | 137/840 |
| 4,369,811 | 1/1983 | Monion et al. | 137/834 |

*Primary Examiner*—A. Michael Chambers

*Attorney, Agent, or Firm*—Anthony T. Lane; Robert P. Gibson; Saul Elbaum

[57] ABSTRACT

A method and apparatus for converting the absolute pressure of a pressurized fluid to a differential pressure indicating the fluid pressure relative to a reference pressure. The pressurized fluid is directed asymmetrically into a laminar proportional amplifier (LPA) along a centerline toward a first of two outlets at a velocity determined by the fluid pressure. The LPA includes first and second control inlets disposed on opposite sides of the directed fluid jet and connected to a common source of control fluid, the first control inlet being disposed on the same side as the first outlet, and the second control inlet being disposed on the same side as the second outlet. The first and second control inlets include respective first and second downstream control edges which are asymmetrically disposed on opposite sides of the jet, with the second control edge being disposed closer than the first control edge to the centerline; consequently, the jet is deflected towards the second outlet in accordance with the jet velocity such that the differential pressure generated by the jet between the first and second outlets is zero when the fluid pressure is equal to the reference pressure.

12 Claims, 5 Drawing Figures

FLUIDIC ABSOLUTE-TO-DIFFERENTIAL PRESSURE CONVERTER

RIGHTS OF THE GOVERNMENT

The invention described herein may be manufactured, used and licensed by or for the United States Government for governmental purposes without the payment to me of any royalties thereon.

BACKGROUND OF THE INVENTION

The invention relates in general to the measurement of fluid pressure and, in particular, to a method and apparatus for converting an absolute fluid pressure to a differential fluid pressure.

In many fluidic circuits, it is necessary to convert the absolute pressure of a pressurized fluid to a differential pressure indicating the pressure of the pressurized fluid relative to a predetermined reference pressure. For example, in a pressure regulating circuit, a single pressure output signal from a rectifier may be used as a control signal to a differential circuit. If the desired reference pressure is available, the unknown pressure can be compared with the reference pressure in a differential amplifier.

However, in many applications, the desired reference signal is not available. In such a case, a passive circuit consisting of a parallel arrangement of an orifice and a capillary can be used to convert the unknown pressure into two flows which can be used as control pressure signals indicating the difference between the unknown pressure and a predetermined reference pressure. When the unknown pressure is correct, the flows are equal and no differential pressure occurs. When the pressure is low, more flow goes through the orifice giving rise to a differential signal in one direction. When the pressure is high, the flow is higher through the capillary giving rise to a differential signal in an opposite direction. Generally, pressure sensors for sensing an unknown fluid pressure inherently have a high input impedance. In this known arrangement, due to this high input impedance, the orifice will always contain a high content of linear or capillary features giving rise to a low sensitivity.

SUMMARY OF THE INVENTION

It is a primary object of the invention to provide a fluidic absolute-to-differential pressure converter which has a high sensitivity without requiring a reference pressure or a separate power supply.

It is another object of the invention to provide a method for converting a single fluid pressure to a differential fluid pressure which does not require a reference pressure source.

The method and apparatus according to the invention utilizes asymmetrical characteristics of laminar proportional amplifiers (LPA). By choosing an LPA designed in such a way as to have a severe mechanical offset, the differential pressure out at low pressures will favor one output over another. By then choosing a nozzle exit configuration and a control edge spacing which cause jet deflection to the opposite side when the gain of the LPA increases with supply pressure, then at high supply pressures, the jet will deflect and favor the other output. By adjusting the control resistance, the set point, i.e., zero differential between the two fluid outputs, can be controlled.

BRIEF DESCRIPTION OF THE DRAWINGS

The invention will be better understood, and further objects, features, and advantages thereof will become more apparent, from the following description of preferred embodiments, taken in conjunction with the accompanying drawings in which.

DESCRIPTION OF PREFERRED EMBODIMENTS

Figure 1:
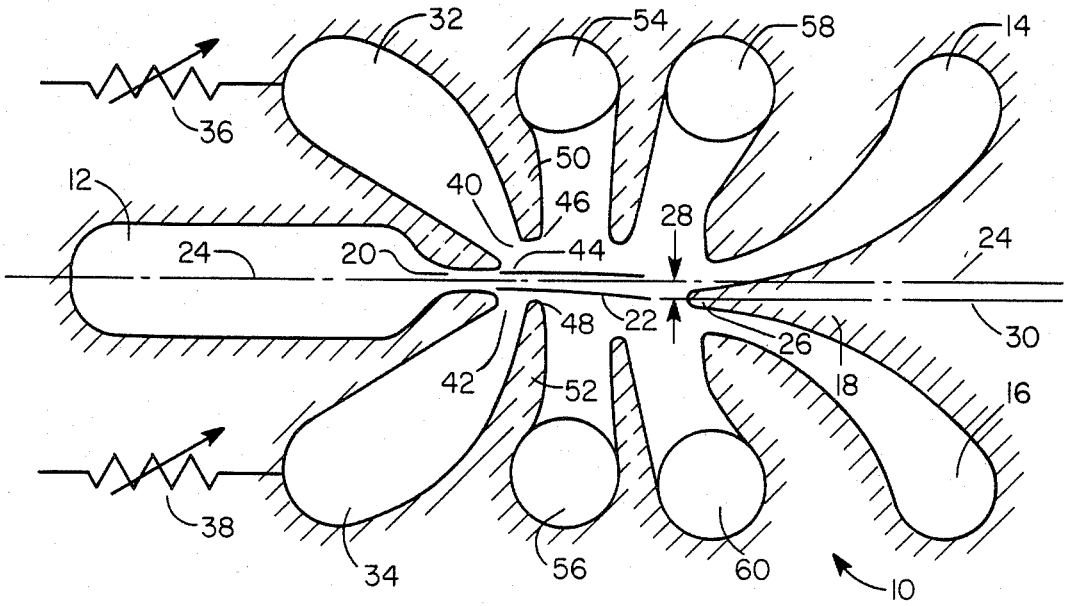
FIG. 1 is a plan view of a first embodiment of the invention.
Figure 2:
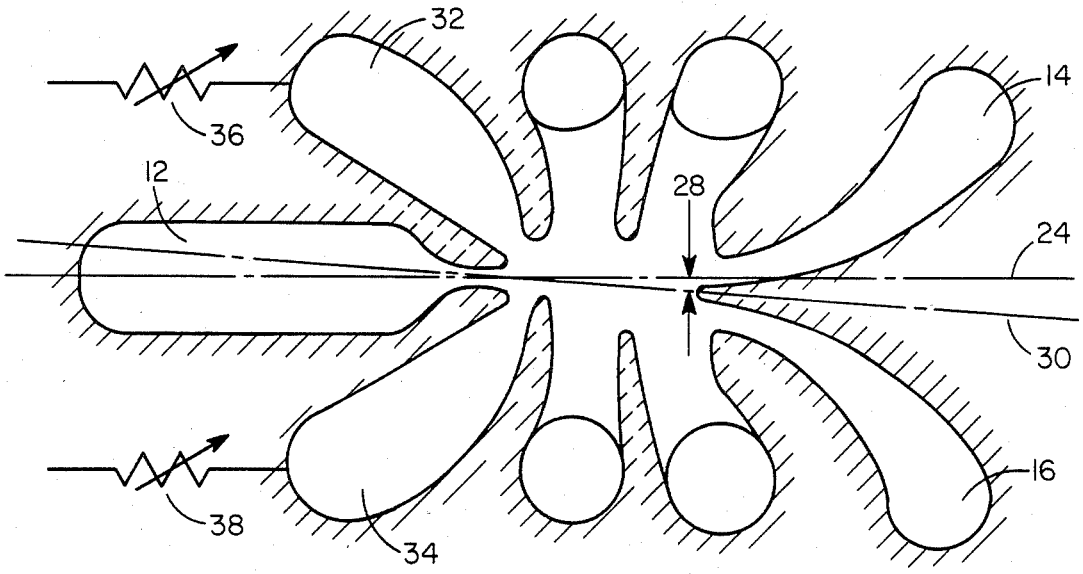
FIG. 2 is a plan view of a second embodiment of the invention.

The absolute-to-differential pressure converter 10 shown in FIG. 1 includes a supply input 12 which is disposed at one end of the converter 10 and is connected to receive a fluid whose absolute pressure is to be converted to a differential pressure indicating the pressure of the fluid relative to a desired reference pressure. Two fluid outlets 14, 16, separated by a splitter 18, are disposed at an opposite end of the converter 10. A supply nozzle 20 is connected in fluid communication with the supply input 12 to direct a fluid supply stream 22 from the supply input 12 into the converter 10 along a centerline 24 of the supply nozzle 22. The supply nozzle centerline 24 is offset in a lateral direction from the upstream end 26 of the splitter 18 by a distance 28 such that at least most of the supply stream 22 is directed by the supply nozzle 20 towards the output 14. For example, when the two outputs 14, 16 are disposed symmetrically on opposite sides of an axis 30 of the splitter, the splitter axis 30 can either be disposed in spaced parallel arrangement with the supply nozzle axis 24, as shown in FIG. 1, or can be disposed to intersect the supply nozzle axis 24 upstream of the splitter 18, as shown in FIG. 2, to achieve the desired lateral offset 28 of the supply nozzle centerline 24 at the splitter end 26.

Two control ports 32, 34 are connected to an available control fluid source through respective adjustable fluid resistors 36, 38, which may be either linear or nonlinear. For example, when the supply stream is formed of pressurized air, the ambient air surrounding the converter 10 can be used as the control fluid source for the control ports 32 and 34. When the fluid used to form the supply stream 22 is a liquid, the control fluid source for the control ports 32, 34 can be a low pressure return line of the fluid system.

The control ports 32 and 34 include respective control nozzles 40, 42, which are disposed on opposite sides of the supply stream 22 to establish fluid communication between the control ports 32, 34 and an interaction zone 44 which extends between the control nozzle 20 and the edges 46, 48 of two control nozzle vanes 50, 52, respectively. The two control nozzle vanes 50, 52 are disposed asymmetrically relative to the supply nozzle axis 24, wherein the vane edge 48 is disposed closer than the vane edge 46 to the axis 24. Since these vane edges 46, 48 determine not only the length but also the lateral extent of the interaction zone 44, this interaction zone 44 is also asymmetrically offset from the supply nozzle centerline 24.

The converter 10 also includes two sets of vents 54 and 56, 58 and 60, which are disposed on opposite sides of the supply stream path intermediate the interaction zone 44 and the outlets 14, 16, and which are open to ambient pressure to provide dumping points for fluid inside the converter 10.

Operation

When the fluid stream 22 is flowing through the converter 10, fluid from the available control fluid source will be drawn through two flow resistors 36, 38, through the two control ports 32, 34, and about the two control nozzle edges 46, 48, respectively, to become entrained with the supply stream 22. Assuming the two flow resistors 36, 38 are adjusted to the same value, more control fluid will be drawn into the supply stream 22 from the control port 34 than from the control port 32 because the control nozzle edge 48 associated with the control port 34 is disposed much closer to the edge of the supply stream 22 than is the control nozzle edge 46 associated with the control port 32. Consequently, the fluid pressure drop through the flow resistor 38 and the control port 34 will be greater than the pressure drop through the flow resistor 36 and the control port 32, and the pressure of the control fluid at the control nozzle 42 will be less than the pressure of the control fluid at the control nozzle 40. Because of this difference in the pressures exerted on opposite sides of the supply stream 22 in the interaction zone 44, the supply stream 22 will be diverted in the direction of the output 16. Thus, the mechanical offset of the control nozzle vanes 50, 52 in one lateral direction from the supply nozzle axis 24 produces an opposite effect on the differential pressure output signal between the two outputs 14, 16 from that of the mechanical offset of the splitter 18 in an opposite lateral direction from the supply nozzle axis 24.

Figure 3:
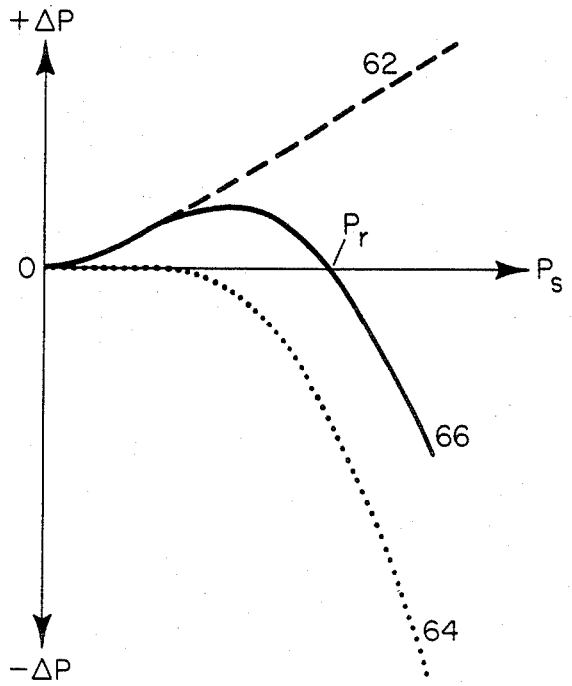
FIG. 3 is a plot of the LPA differential output signal versus the LPA input pressure signal.
Figure 4:
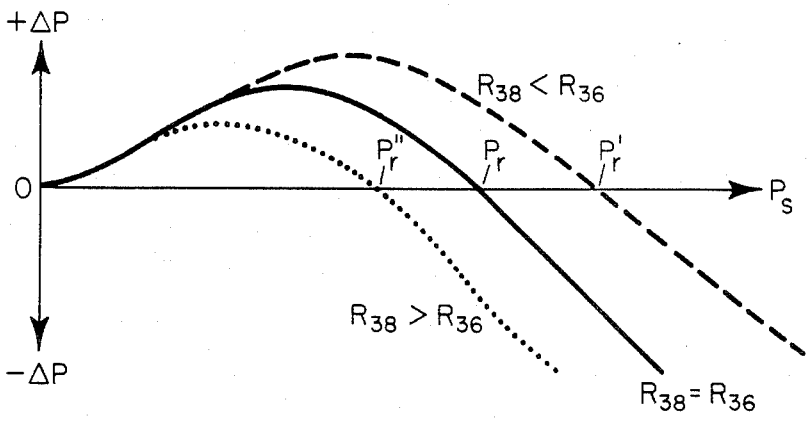
FIG. 4 is a family of curves of LPA input versus output pressure signals for respective LPA control resistances.

FIGS. 3 and 4 show various curves of the supply pressure $P_s$ at the converter supply input 12 versus the differential pressure $\Delta P$ produced between the two converter outputs 14 and 16. In order to indicate whether the pressure at one output 14 is greater or less than the pressure at the other output 16, the differential pressure $\Delta P$ has arbitrarily been designated as a positive value when the pressure at the output 14 is greater than the pressure at the output 16, and as a negative value whenever the pressure at the output 14 is less than the pressure at the output 16.

Curve 62, shown as a dashed line in FIG. 3, is a plot of the supply pressure $P_s$ versus the differential pressure $\Delta P$ which would be produced between the two outputs 14, 16 of the converter 10 solely as a result of the mechanical offset of the splitter 18 described above. Curve 62 shows that this mechanical offset of the splitter causes the output differential pressure $\Delta P$ to monotonically increase in the positive direction with an increase in the supply pressure $P_s$. The rate of change of the output differential pressure $\Delta P$ increases due to a reduction of viscous losses as the supply pressure $P_s$ increases.

Curve 64, shown as a dotted line in FIG. 3, is a plot of the supply pressure $P_s$ versus the output differential pressure $\Delta P$ which would be produced solely as a result of the mechanical offset of the control nozzle vanes 50, 52, described above. As shown by curve 64, the mechanical offset of the control nozzle vanes 50, 52 results in a nonlinear change in the output differential pressure $\Delta P$ as a function of increasing supply pressure $P_s$. Essentially no change in the output differential pressure $\Delta P$ is produced at low supply pressures since there is no LPA gain. Thereafter, when the gain becomes appreciable, the output differential pressure $\Delta P$ rapidly increases in the negative direction.

Curve 66, shown as a solid line in FIG. 3, shows a plot of the supply pressure $P_s$ versus the output differential pressure $\Delta P$ produced as a result of the control nozzle vanes 50, 52 and the flow splitter 18 being oppositely offset from the supply nozzle centerline 24. Curve 66 clearly shows that these two mechanical offsets produce opposite effects on the output differential pressure $\Delta P$. At low supply pressures $P_s$, the effect of the mechanical offset of the flow splitter 18 predominates, and the output differential pressure $\Delta P$ increases the positive direction with increasing supply of pressure $P_s$. Thereafter, as the supply $P_s$ continues to increase, the effect of the mechanical offset of the control nozzle vanes 50, 52 predominate, and the output differential pressure $\Delta P$ increases in the opposite negative direction. The geometry of the converter 10 can be set so that the output differential pressure $\Delta P$ is zero at the desired reference pressure $P_r$. The slope of the curve 66 corresponds to the converter sensitivity. Typically, the value of $(\Delta P)/\Delta P_s$ is in the range of about 0.1 to 2.0 at the reference pressure $P_r$.

The supply pressure $P_s$ at which the output differential pressure $\Delta P$ crosses zero, corresponding to the desired referenced pressure, can be varied by varying the resistance value of either flow resistor 36 or 38. If the resistance of the flow resistor 38 is increased, the jet edge pressure adjacent to vane edge 48 will be reduced by restriction of the entrained flow of control fluid, and the jet deflection will be augmented. Similarly, an increase in the resistance value of the flow resistor 36 will cause less jet deflection. By varying the ratio of the two flow resistors 36 and 38, the zero crossing or set point $P_r$ of the output differential pressure can be adjusted, as seen in FIG. 4.

The curve shown by a solid line in FIG. 4 is a plot of the supply pressure $P_s$ versus the differential pressure $\Delta P$ where the resistance $R_{38}$ of the flow resistor 38 is equal to the resistance $R_{36}$ of the flow resistor 36. This curve can be changed to that shown by a dashed line in FIG. 4 to thus raise the set point $P_r$ to $P_r'$ by either increasing the resistance $R_{36}$ of the flow resistor 36 or decreasing the resistance $R_{36}$ of the flow resistor 38 so that $R_{38}<R_{36}$. Similarly, the curve can be changed to that shown by a dotted line in FIG. 4 to lower the set point $P_r$ to $P_r''$ by either increasing the resistance $R_{38}$ of the flow resistor 38 or decreasing the resistance $R_{36}$ of the flow resistor 36 so that $R_{38}>R_{36}$.

An example of a fluidic absolute-to-differential pressure converter 10, such as shown in FIG. 1, is seen below. In this example, the pressurized fluid is pressurized air and the control fluid is air at atmospheric pressure. The converter 10 has a supply flow rate of 0.3 liters per minute through the converter at 4 mm of Hg supply pressure through a supply nozzle 20 with a cross-section of $0.02\times0.02$ inches. The fluid outputs 14 and 16 are 0.027 inches wide by 0.020 inches deep. The flow splitter 18 has a rounded upstream end 26 of approximately 0.005 inch radius which is spaced from the supply nozzle 20 by a distance of approximately 0.180 inch. The flow centerline 30 of the splitter 18 is offset 0.005 inch from the supply nozzle centerline 24 in one lateral direction, and the centerline of the control nozzle vanes 50, 52 are offset 0.001 inch from the supply nozzle centerline 24 in an opposite lateral direction, as shown in FIG. 1. The edge 46 of the control nozzle vane 50 is spaced approximately 0.0135 inch from the centerline 24, and the control nozzle vane 52 is spaced approximately 0.0115 inch from the centerline 24. The two control nozzle vanes 50, 52 are disposed downstream from the supply nozzle 20 by a distance of approximately 0.02 inch along the centerline 24. When the atmospheric vents or flow resistors 36, 38 have equal flow resistances, an absolute-to-differential pressure converter of this design produces a differential pressure between the two outputs 14, 16 of the value of zero at the stated supply pressure of 4 mm of Hg.

Figure 5:
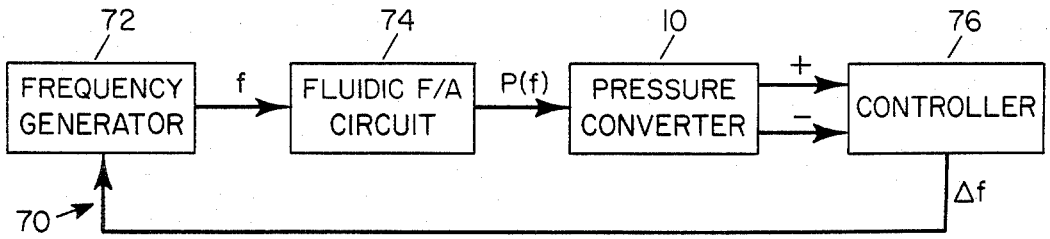
FIG. 5 is an electrical schematic diagram of a frequency control circuit which includes the absolute-to-differential pressure converter described herein.

A typical application of the invention described herein can be seen in FIG. 5. FIG. 5 discloses a fluidic automatic frequency control circuit 70 where the frequency impulses from a fluid oscillator frequency generator 72 are converted to the output pressure of the fluid frequency-to-analog convertor 74. The output pressure of the f/A converter 74 is converted to a differential pressure in the fluid outputs of an absolute-to-differential pressure converter 10, as described above. This differential signal is then fed to a high gain amplifier controller 76, which utilizes this signal to provide a feedback signal 78 in the form of an adjusted supply pressure to the frequency generator 72. The differential signals from the fluid absolute-to-differential converter 10 can also be used as control inputs in an array of fluid amplifiers downstream from the absolute-to-differential converter to form a pressure regulator with no moving parts.

One advantage of the absolute-to-differential pressure converter described herein is that it has the low output impedance of an LPA and readily matches into other LPA circuitry. Also, a high input impedance is possible by the choice of a supply nozzle size that does not affect sensitivity. Further, this converter requires neither a separate power supply nor a pressure reference. It has the advantage over mechanical devices such as pressure regulators in that it includes no moving parts, and is thus highly reliable, and there is no mechanical friction forces to overcome, thus giving response to any pressure changes.

Since many modifications, variations, and additions to the invention are possible within the spirit of the invention in addition to the specific embodiments described herein, it is intended that the scope of the invention be limited only by the appended claims.

What is claimed and desired to be secured by Letters Patent of the United States is:

1. An absolute-to-differential pressure converter for converting the absolute pressure of a pressurized fluid to a differential pressure indicating the pressure of the pressurized fluid relative to a predetermined reference pressure, comprising:

input means, connected to receive said pressurized fluid, for directing a jet of fluid along a first centerline at a velocity determined by said absolute pressure;

output means, disposed downstream from said input means, including first and second outlets separated by a splitter which is disposed asymmetrical to said first centerline such that at least a greater portion of said jet directed along said first centerline is received at the first outlet; and control means for deflecting said jet towards said second outlet in accordance with said jet velocity such that the differential pressure generated by the jet between the first and second outlets is zero when said absolute pressure is equal to said predetermined reference pressure.

2. An absolute-to-differential pressure converter, as described in claim 1, wherein the control means comprises:

a first vane which is disposed downstream from the input means on a first side of the jet adjacent the first outlet and which extends radially inward toward the first centerline to a first control edge;

a second vane which is disposed opposite the first vane on a second side of the jet adjacent the second outlet and which extends radially inward toward the first centerline to a second control edge which is disposed closer to the first centerline than the first control edge;

an interaction zone which is defined by and extends between the input means and the first and second vanes;

a source of control fluid of low pressure which is constant relative to the predetermined reference pressure;

a first resistive fluid communication means for connecting the control fluid source in fluid communication with the first side of the jet in the interaction zone, and a second resistive fluid communication means for connecting the control fluid source in fluid communication with the second side of the jet in the interaction zone.

3. An absolute-to-differential pressure converter, as described in claim 2, wherein at least one of the first and second resistive fluid communication means includes a variable fluidic resistor.

4. An absolute-to-differential pressure converter, as described in claim 2, wherein the first and second resistive fluid communication means include respective variable fluidic resistors.

5. An absolute-to-differential pressure converter, as described in claim 2, which further comprises means for venting fluid interposed between the first and second vanes and the output means.

6. An absolute-to-differential pressure converter, as described in claim 5, wherein:

the pressurized fluid is pressurized air;

the control fluid source is ambient air at atmospheric pressure; and the fluid venting means include at least one pair of vents disposed respectively on opposite sides of the jet between the first and second vanes and the output means for establishing fluid communication between the ambient air and the opposite sides of the jet.

7. An absolute-to-differential pressure converter, as described in claim 1, wherein the splitter includes a centerline and the splitter is disposed asymmetrical to the first centerline of the input means by positioning the splitter such that the splitter centerline is parallel to and offset from the first centerline.

8. An absolute-to-differential pressure converter, as described in claim 1, wherein the splitter includes a centerline and the splitter is disposed asymmetrical to the first centerline of the input means by positioning the splitter such that the splitter centerline intersects the first centerline.

9. An absolute-to-differential pressure converter, as described in claim 1, wherein said control means comprises:

a source of control fluid of constant pressure relative to said predetermined reference pressure;

a first resistive fluid communication means, connected between said control fluid source and a first side of said jet adjacent the first outlet, for supplying control fluid to the first side of the jet; and a second resistive fluid communication means, connected between said control fluid source and an opposite second side of the jet adjacent the second output, for supplying control fluid to the second side of the jet, the fluid resistance of the second resistive fluid communication means being greater than the fluid resistance of the first resistive fluid communication means.

10. An absolute-to-differential pressure converter for converting the absolute pressure of a pressurized fluid to a differential pressure indicating the absolute pressure of the pressurized fluid relative to a predetermined reference pressure, comprising:

input means, connected to receive said pressurized fluid, for directing a jet of fluid in a forward direction along a first centerline at a velocity determined by said absolute pressure;

output means, displaced in said forward direction from said input means, including first and second outlets separated by a splitter which is disposed asymmetrical to said first centerline such that at least a greater portion of said jet directed along said first centerline is received at the first outlet; and control means for deflecting said jet towards said second outlet in accordance with said jet velocity such that the differential pressure generated by the jet between the first and second outlets is zero when said absolute pressure is equal to said predetermined reference pressure, said control means including first and second control inlets respectively disposed on opposite sides of said jet and connected to a common source of control fluid through respective first and second fluidic resistive means, said second control inlet being disposed on the same side of said first centerline as said second outlet, said first and second control inlets including respective first and second forward control edges which are asymmetrically disposed on opposite sides of said jet so that said second control edge is disposed closer than said first control edge to said first centerline.

11. A method for converting an absolute pressure of a pressurized fluid to a differential pressure indicating the pressure of the pressurized fluid relative to a predetermined reference pressure, which comprises the steps of:

directing a jet of fluid outwardly from a nozzle along a first centerline at a velocity determined by said absolute velocity;

disposing downstream of the nozzle an output assembly including first and second outlets separated by a splitter which is positioned asymmetrical to said first centerline such that at least a greater portion of said jet directed along said first centerline is received at the first outlet; and deflecting said jet towards said second outlet in accordance with said jet velocity such that the differential pressure generated by the jet between the first and second outlets is zero when said absolute pressure is equal to said predetermined reference pressure.

12. An absolute-to-differential pressure converter for converting the absolute pressure of a pressurized fluid to a differential pressure indicating the pressure of the pressurized fluid relative to a predetermined reference pressure, comprising:

input means, connected to receive said pressurized fluid, for directing a jet of fluid along a first centerline at a velocity determined by said absolute pressure;

output means, disposed downstream from said input means, including first and second outlets separated by a splitter which is disposed asymmetrical to said first centerline such that at least a greater portion of said jet directed along said first centerline is received at the first outlet; and control means for deflecting said jet towards said second outlet in accordance with said jet velocity such that the differential pressure generated by the jet between the first and second outlets is zero when said absolute pressure is equal to said predetermined reference pressure, the pressure at said first outlet becoming greater than the pressure at said second outlet when said absolute pressure falls below said reference pressure, and the pressure at said second outlet becoming greater than the pressure at said first outlet when said absolute pressure rises above said reference pressure.

* * * * *